US008034281B2

(12) United States Patent
Lowance

(10) Patent No.: US 8,034,281 B2
(45) Date of Patent: Oct. 11, 2011

(54) DUAL CONTAINER SYSTEM

(76) Inventor: Philip D. Lowance, Dana Point, CA (US)

( * ) Notice: Subject to any disclaimer, the term of this patent is extended or adjusted under 35 U.S.C. 154(b) by 1239 days.

(21) Appl. No.: 11/376,350

(22) Filed: Mar. 15, 2006

(65) Prior Publication Data

US 2007/0215617 A1 Sep. 20, 2007

(51) Int. Cl.
*B29C 49/06* (2006.01)

(52) U.S. Cl. ..... 264/537; 264/512; 264/513; 264/523

(58) Field of Classification Search ..... 264/527
See application file for complete search history.

(56) References Cited

U.S. PATENT DOCUMENTS

| | | | | |
|---|---|---|---|---|
| 251,566 | A | 12/1881 | Fuller | |
| 519,601 | A | 5/1894 | Dryfoos | |
| 849,211 | A | 4/1907 | Daly | |
| D100,412 | S | 7/1936 | Carp | |
| 2,374,092 | A | 4/1945 | Glaser | |
| 2,493,922 | A | 1/1950 | Miller | |
| 2,780,225 | A | 2/1957 | Barr et al. | |
| D219,642 | S | 1/1971 | Prahs | |
| D220,864 | S | 6/1971 | Weckman | |
| 3,590,989 | A | 7/1971 | Witter | |
| 4,235,343 | A | 11/1980 | Thompson | |
| D270,429 | S | 9/1983 | Anderson et al. | |
| 4,640,423 | A | 2/1987 | Mednis | |
| 4,673,094 | A | 6/1987 | Mednis | |
| 4,708,253 | A | 11/1987 | Mednis | |
| 4,925,066 | A | 5/1990 | Rosenbaum | |
| 4,950,083 | A | 8/1990 | Bavaveas | |
| 5,065,875 | A * | 11/1991 | Balavich | 215/10 |
| 6,241,938 | B1 * | 6/2001 | Barel et al. | 264/521 |

FOREIGN PATENT DOCUMENTS

| | | |
|---|---|---|
| CH | 301579 | 11/1954 |
| DE | 729092 | 12/1942 |
| FR | 2375105 | 12/1976 |
| NL | 34758 | 1/1934 |

OTHER PUBLICATIONS

Rosato, Dominick, Donald Rosato, and Marlene Rosato. Injection Molding Handbook. 3rd ed. 2000: Kluwer Academic Publishers. p. 32.*

* cited by examiner

*Primary Examiner* — Monica A Huson

(57) ABSTRACT

A container system is adapted to withstand impacts and features a first container having a first container body and a second container having a second container body. The second container defines a second body height and a second body wall thickness. A body recess is formed in the second container body for releasably engaging the first container body of the first container. A body recess defines at least one recess top and bottom corner and recess vertical edge having a recess top and bottom corner and vertical edge wall thickness, respectively, and which are intentionally thinned so as to have a thickness that is less than the second body wall thickness. The recess top and bottom corners and vertical edges are specifically configured to be deformable in response to an impact imposed thereagainst such that at least a portion of the impact shock is absorbed by the deformation in order to avoid rupture of the second container.

9 Claims, 6 Drawing Sheets

X = failure
O = nonfailure (pass)

| Drop Height, Feet | Record Outcome of Each Test After the Initial Fail/Pass Point is Reached: | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 |
| 10 | | | | | | | | | O | O | | | | | | | | | | |
| 9 | | | | | | | | O | | | | | | | | | | X | | O |
| 8 | | | | | X | | O | | | | | | | | | | O | | O | |
| 7 | | | | O | | O | | | | | | | | | | O | | | | |
| 6 | | | O | | | | | | | | | | X | | O | | | | | |
| 5 | | O | | | | | | | | | | O | | O | | | | | | |
| 4 | O | | | | | | | | | | O | | | | | | | | | |
| 3 | | | | | | | | | | | | | | | | | | | | |
| 2 | | | | | | | | | | | | | | | | | | | | |
| 1 | | | | | | | | | | | | | | | | | | | | |

*Fig. 13a*

X = failure
O = nonfailure (pass)

| Drop Height, Feet | Record Outcome of Each Test After the Initial Fail/Pass Point is Reached: | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 |
| 10 | | | | | | | | | | | | | | | | | X | | | |
| 9 | | | | | | | | X | | O | | | | | | O | | X | | |
| 8 | | | | | X | | O | | O | | | | | | O | | | | X | |
| 7 | | | | O | | O | | | | | | | | O | | | | | | X |
| 6 | | | O | | | | | | | | | | O | | | | | | | |
| 5 | | O | | | | | | | | | | O | | | | | | | | |
| 4 | O | | | | | | | | | | O | | | | | | | | | |
| 3 | | | | | | | | | | | | | | | | | | | | |
| 2 | | | | | | | | | | | | | | | | | | | | |
| 1 | | | | | | | | | | | | | | | | | | | | |

*Fig. 13b*

X = failure
O = nonfailure (pass)

| Drop Height, Feet | Record Outcome of Each Test After the Initial Fail/Pass Point is Reached: | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 |
| 10 | | | | | | | | | | | | | | | | | | | | |
| 9 | | | | | | | | | | | | | | | | | | | | |
| 8 | | | | | | | X | | | | | | | | | | | | X | |
| 7 | | | | | | O | | X | | | | | | | | | | O | | X |
| 6 | | | X | | O | | | | X | | | | X | | | | O | | | |
| 5 | | O | | O | | | | | | O | | O | | X | | O | | | | |
| 4 | O | | | | | | | | | | O | | | | O | | | | | |
| 3 | | | | | | | | | | | | | | | | | | | | |
| 2 | | | | | | | | | | | | | | | | | | | | |
| 1 | | | | | | | | | | | | | | | | | | | | |

*Fig. 13c*

DUAL CONTAINER SYSTEM

CROSS-REFERENCE TO RELATED APPLICATIONS

The present invention is related to commonly-owned U.S. application Ser. No. 10/945,723 filed on Sep. 21, 2004, and commonly-owned U.S. application Ser. No. 11/091,330 filed on Mar. 28, 2005, both of which are entitled Dual Container System and Method of Manufacturing Same and both of which are continuation-in-part applications of U.S. application Ser. No. 10/614,438 entitled Dual Container System and Method of Manufacturing Same, filed on Jul. 3, 2003, the entire contents of each being expressly incorporated by reference herein.

STATEMENT RE: FEDERALLY SPONSORED RESEARCH/DEVELOPMENT (Not Applicable)

BACKGROUND OF THE INVENTION

The present invention relates generally to dual container systems and, more particularly, to an improved dual container system featuring an impact-resistant container which possesses corner portions that are uniquely adapted to deform in response to impacts imposed thereagainst without causing rupturing of the container and spillage of the container contents.

It is a common practice for manufacturers and/or retailers to employ the use of containers for packaging their products and making them available in the marketplace. These containers not only protect the products from contamination but facilitate the use of such products. Indeed, the significance and importance of providing user-friendly containers is appreciated by various industries as such containers can increase the overall attractiveness and appeal of certain products in the marketplace.

One notable type of user-friendly container currently in use is the dual container system which typically allows large and small containers to be cooperatively engaged to one another. Dual container systems offer the convenience and freedom of product mobility as the smaller container can be engaged to the larger container such that both containers can be carried as a single unit. Conveniently, the smaller container can be disengaged from the larger container as desired by the consumer. To illustrate this point by way of an example, the dual container system may be adapted for traveling as the smaller container containing a product such as shampoo or soap may be carried with the larger container. This obviously reduces the total number of items that a traveler must carry.

Although prior art or conventional dual container systems may achieve their primary objective of user-friendliness, they possess certain deficiencies which detract from their overall utility. Perhaps the greatest deficiency of conventional dual container systems is the inability to withstand single or repetitive impacts that may be imposed in certain environments. More specifically, dual container systems of the prior art are frequently subject to tear and/or rupture as they may be repeatedly dropped and/or mishandled during shipment and/or storage.

In particular, the larger container which is used for engaging the smaller container of the dual container system is typically vulnerable to tear and/or rupture along its edges. Even more particularly, areas of the larger container that have the highest susceptibility to rupture are typically located at the outer boundaries of the large container body. Typically, recess edges along the bottom portion of the body recess are most susceptible to rupture. When fabricated of certain materials, such bottom corners of the large container tend to fracture and/or crack upon impact with a hard surface. The fracturing or cracking of the large container is due in part to the geometry of the container body and the material from which it is fabricated.

In this regard, extreme thinness of the bottom corners is understood to be a result of manufacturing deficiencies in which insufficient amounts of preform materials are distributed to that region. As such, much of the effort in the prior art is directed toward increasing the thickness of such corner sections in the larger container. For example, U.S. patent application Ser. Nos. 10/945,723 and 11/091,330 have a common assignee as in the present application and being filed, respectively, on Sep. 21, 2004 and Mar. 28, 2005, the entire contents of both being expressly incorporated by reference herein, are directed at increasing the thickness of such corners to a sufficient degree that the corners are resistant to structural failure and rupture of the large container.

More particularly, the above referenced patent applications were directed at increasing the thickness of the bottom corners of the recess to the same or greater thickness as that of the remainder or majority of the larger container. In this regard, others in the prior art have recognized the design deficiency inherent in thinning at the corner areas of plastic containers. It is well recognized in the prior art that unduly thin corners in certain container systems can have the negative impact of spillage of all product contained within the larger container upon impact with an object. The thickening of such bottom corners as disclosed in the above-referenced patent applications has remedied the deficiency associated with rupturing when the corners are subjected to impact.

However, it has been discovered that an alternative approach to preventing rupturing of such dual container system may include the use of a unique geometry which employs manufacturing technology in combination with a complementary material system. More specifically, by intentionally configuring certain impact-prone areas of the container to provide impact absorption instead of attempting to provide impact resistance by thickening of such corners, rupturing of the container is also prevented. Furthermore, it has been discovered that the impact absorption approach to rupture prevention results in a robust container system capable of surviving greater (i.e., more forceful) impacts than prior art containers employing the impact resistance approach.

BRIEF SUMMARY OF THE INVENTION

The present invention specifically addresses and alleviates the above-referenced deficiencies associated with prior art dual container systems. More particularly, the present invention is a dual container system comprising a second (i.e., larger) container adapted to releasably engage a first (i.e., smaller) container. In this regard, the dual container system is specifically configured to provide enhanced product mobility by providing an overall system in which the first container (i.e., the smaller container) may be releasably engaged to the second container (i.e., the larger container). Importantly, the second container includes intentionally thinned corner wall portions in relation to the wall thickness of the remainder of the second container body. In this manner, the second container may withstand repeated impacts imposed thereupon. Such impacts may be the result of accidental dropping of the second container during manufacturing, shipping or in a retail setting.

In contravention to certain prior art systems, the dual container system of the present invention provides for a controlled thinning of certain corner wall portions in the second container that are specifically configured to deform and absorb at least some of the shock that would otherwise be transmitted in greater magnitude to the second container body. In this manner, the second container may be capable of withstanding single and/or repeated impacts. Furthermore, the dual container system may be fabricated from an optimized material system that can provide the necessary rupture-resistant characteristics to prevent rupture and spillage of the contents (e.g., shampoo, body wash, detergent, lotions, etc.) of the second container.

Such materials may include, but are not limited to, extrusion blow-moldable copolyester material, polyvinyl chloride (PVC), clarified polypropylene, polyethylene, polycarbonate, etc. However, any other suitable polymeric or plastic material may be utilized. The second container includes a second container body that defines a second body height, a second body wall thickness and opposing second body sides connected on the bottom by a bottom panel. Proximal and distal parting lines are defined on respective ones of the second body sides and are extended along the second body height.

The second container body further includes a body recess specifically configured and adapted to releasably engage the first container body. The generally vertically extending body recess defines a recess top portion having recess top corners which each define a recess top corner wall thickness. The recess is configured to allow at least a portion of the first container body to protrude vertically out of the body recess when engaged to the second container. The body recess may further include a recess bottom portion having a pair of recess bottom corners which each define a recess bottom corner wall thickness. The recess further includes recess vertical edges extending between the recess top and bottom corners with each vertical edge defining a recess vertical edge wall thickness. As was earlier mentioned, at least one of the important aspects of the present invention is the specific geometry of the recess top and bottom corner wall thicknesses wherein the recess top and bottom corners have a generally thinned cross section such that the recess top and bottom corners may absorb some of the impact without causing rupture of the second container body. Furthermore, the recess vertical edge wall thicknesses of the recess also preferably have a generally thinned cross section to allow for absorption of at least some of the shock imparted to the container upon impact with an object or surface.

Importantly, the recess top and bottom corners as well as the recess vertical edges are specifically configured to be deformable, crushed or partially collapsed in response to impact caused upon the recess top and bottom corners and vertical edges such as may occur when the second container body is dropped from a height onto a hard surface such as a floor or tabletop. Due to the deformable nature of the recess top and bottom corners and vertical edges, shock that would otherwise be imparted to the whole of the second container body is attenuated and reduced due to crushing of the affected areas. Such reduced shock loads are therefore transmitted to generally thicker portions of the second container which may have greater resistance to rupture. In this manner, spillage of the contents contained within the second container body is prevented during impact.

BRIEF DESCRIPTION OF THE DRAWINGS

These as well as other features of the present invention will become more apparent upon reference to the drawings wherein:

FIGS. 13*a*-13*c* are data charts illustrating results of the drop impact testing of the second container.

DETAILED DESCRIPTION OF THE INVENTION

Figure 1:
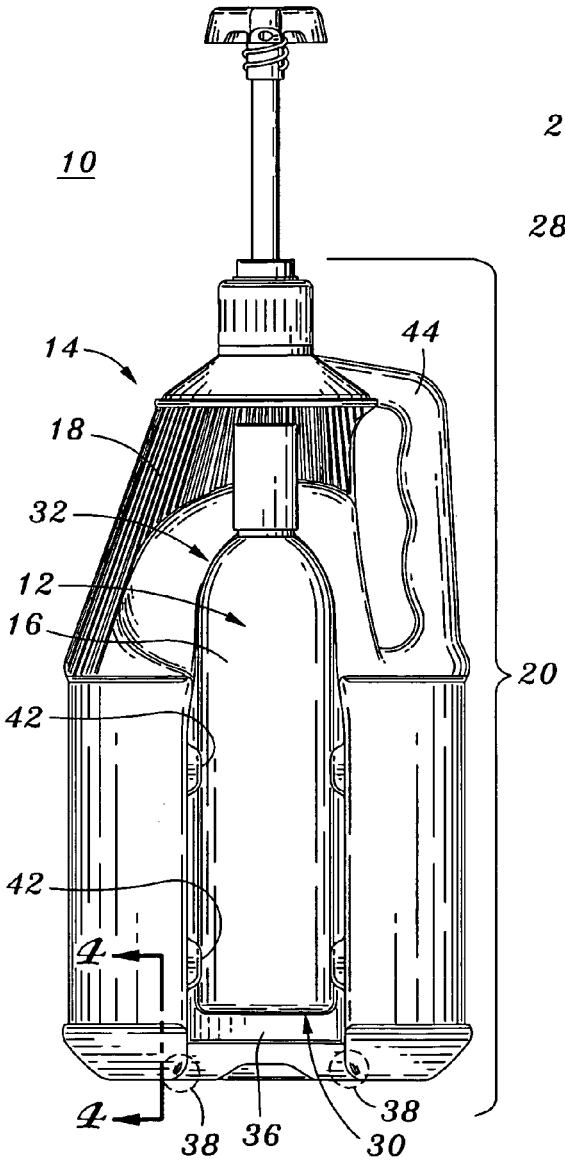
FIG. 1 is a side view of a dual container system constructed in accordance with a preferred embodiment of the present invention and illustrating a second container which is adapted to accommodate and engage a first container via a body recess formed in the second container.

Referring now to the drawings wherein the showings are for purposes of illustrating preferred embodiments of the present invention only, and not for purposes of limiting the same, FIG. 1 illustrates a dual container system 10 constructed in accordance with a preferred embodiment of the present invention. Similar to its prior art counterparts, the dual container system 10 of the present invention is, specifically configured to offer the convenience and freedom of product mobility by providing an overall system in which a first container 12 (i.e., a smaller container) can be engaged and disengaged from a second container 14 (i.e., a larger container).

However, unlike its prior art counterparts, the dual container system 10 of the present invention is specifically adapted such that certain portions of the second container 14 have intentionally thinned areas. More specifically, the recess top and bottom corners 38, 78 and recess vertical edges 82 are intentionally thinned in relation to the wall thickness of the remainder of the body, as is shown in FIGS. 12 and 12*a*-12*c*. Due to the controlled thinning of such recess top and bottom corners 38, 78 and recess vertical edges 82, the container 10 may withstand single and/or repeated impacts. Furthermore, the dual container system 10 includes a uniquely-configured horizontal support for accommodating the first container 12 when it is engaged to the second container 14. Such features will be explained in greater detail below.

The first and second containers 12, 14 are preferably manufactured and utilized for the purpose of accommodating and containing various products including, but not limited to, shampoos, body wash, detergent, lotions, pet food and other products. In this regard, the first and second containers 12, 14 may be formed to have a variety of various shapes, configurations, geometries and surface textures which are sufficient for accommodating and containing the aforementioned products. Although the containers comprising the dual container system 10 of the present invention may be fabricated from any material that can provide the necessary structural rigidity and strength, it is preferred that the dual container system 10 is fabricated from a polymeric or plastic material. Such plastic material may include extrusion blow-moldable copolyester material, polyvinyl chloride (PVC), clarified polypropylene, polyethylene, and polycarbonate. However, any other suitable polymeric or plastic material may be utilized for fabricating the dual container system 10.

Figure 2:
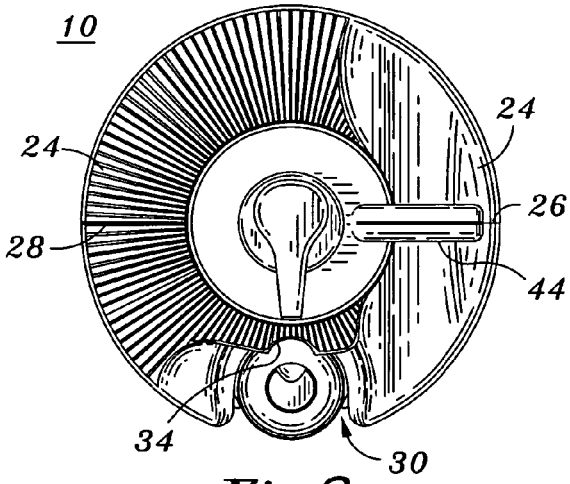
FIG. 2 is a top plan view of the dual container system shown in FIG. 1 and illustrating the body recess of the second container which is angularly offset about 90° from a handle and body parting lines.
Figure 3:
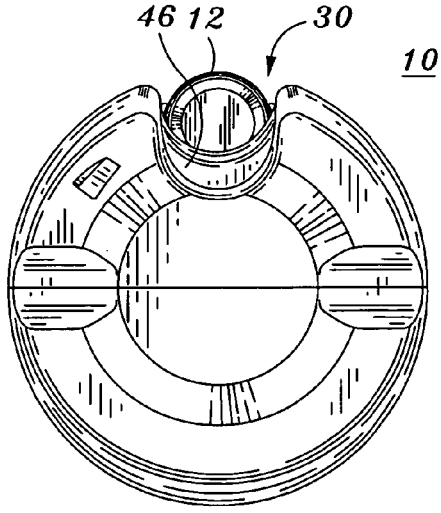
FIG. 3 is a bottom plan view of the dual container system shown in FIG. 1 and illustrating a supporting shelf which is formed and extended within the body recess of the second container for supporting the first container.
Figure 4:
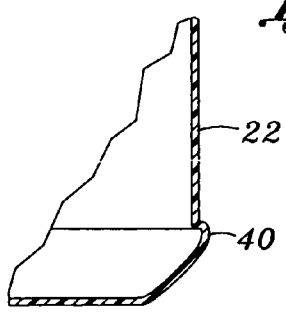
FIG. 4 is a partial cross-sectional view of the second container shown in FIG. 1.
Figure 5:
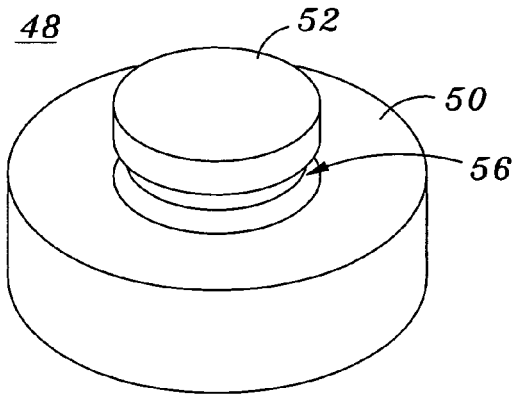
FIG. 5 is a perspective view of an injection control unit of a blow molding machine and which may be utilized for manufacturing the present dual container system of FIG. 1.
Figure 6:
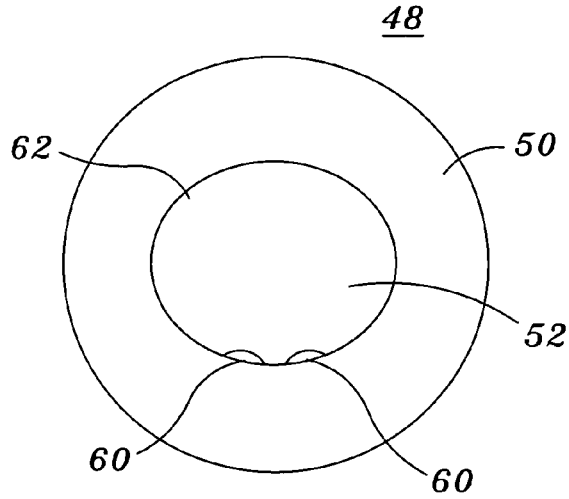
FIG. 6 is a top plan view of the injection control unit shown in FIG. 5 and illustrating the injection control member which provides two injection scallops designated for forming the body recess of FIG. 1.

Referring more particularly now to FIGS. 1-3, as the first and second containers 12, 14 may be any generally desired shape, it is understood that the containers 12, 14 as depicted are symbolic or exemplary in nature. As discussed above, it is the inventive concept providing the dual container system 10 with improved impact resistance and with a horizontal support that should be appreciated in the foregoing disclosure. However, the first and second containers 12, 14 are each depicted as having a generally cylindrical configuration but of different sizes. In this regard, the first and second containers 12, 14 are each shaped as a bottle-like container, with the second container 14 being generally larger in size than the first container 12. As may be appreciated, such sizing differential between the first and second containers 12, 14 is inevitable as the second container 14 is specifically adapted to engage in support and contain the first container 12 therewithin.

Referring back to FIG. 1, the first container 12 of the dual container system 10 has a first container body 16. Likewise, the second container 14 has a second container body 18. Although the following disclosure is devoted mostly to describing the unique aspects and specifications of the second container body 18 due to its increased resistance to rupture, one of ordinary skill in the art will recognize that the first container body 16 may be manufactured to closely resemble or copy the manufacturing methodology and materials used in manufacturing the second container body 18. Alternatively, the first container body 16 may be made in accordance with conventional manufacturing principles and does not necessarily follow the unique manufacturing methodology of the second container body 18.

Referring now to FIGS. 1-4 and 12-12*a*, the second container body 18 defines a second body height 20, a second body wall thickness 22, and two opposing second body sides 24. The second container body 18 also has a proximal parting line 26 and a distal parting line 28. More specifically, the proximal and distal parting lines 26, 28 are defined on respective ones of the opposing second body sides 24. The proximal and distal parting lines 26, 28 are extended along the second body height 20 of the second container body 18.

Importantly, the second container body 18 forms a body recess 30 which is specifically configured and adapted to releasably engage the first container body 16 of the first container 12. In particular, the body recess 30 is formed as part of the second container body 18 and in this regard, is extended along the second body height 20. The body recess 30 defines a recess top portion 32 which may be configured to expose at least a portion of the first container body 16 as it engages the body recess 30.

Optionally, the second container body 18 may include a finger-indent 34 adjacent the recess top portion 32 in order to facilitate detachment of the first container body 16 from the body recess 30 as best shown in FIG. 2. Opposite from the recess top portion 32 along their second body height 20 is a recess bottom portion 36 of the body recess 30. The recess bottom portion 36 includes at least one and, preferably, a pair of the recess bottom corners 38 which each define a recess bottom corner wall thickness 40, as can be seen in FIG. 12 and the significance of which will be described in greater detail below.

Figure 12C:
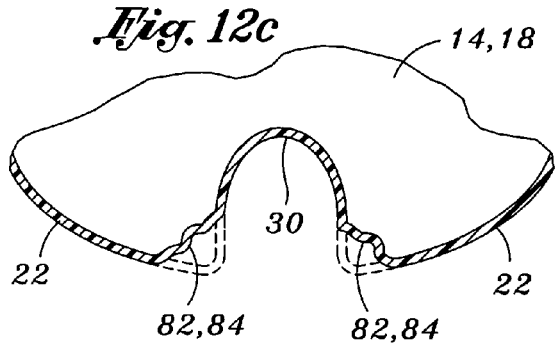
FIG. 12*c* is an enlarged cross sectional view of a recess top corner area of the second container having a partially collapsed wall thickness as a result of the drop impact testing.
Figure 12:
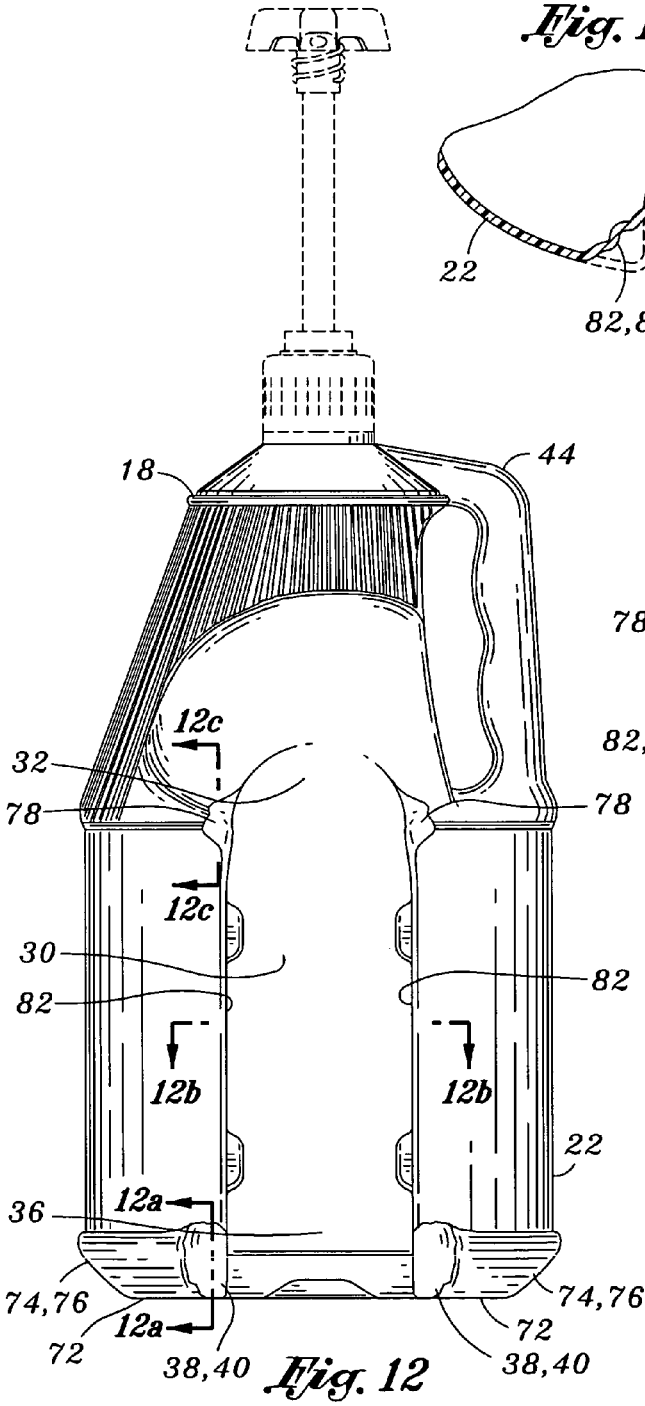
FIG. 12 is side view of the second container and illustrating the second container being filled with liquid for drop impact testing performed thereon under ASTM D 2463.
Figure 12B:
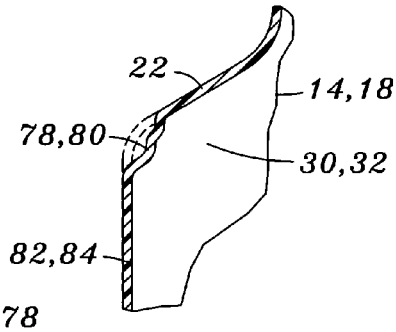
FIG. 12*b* is an enlarged cross sectional view of a recess vertical edge of the second container having a partially collapsed wall thickness as a result of the drop impact testing.

As seen in FIG. 12*c*, the body recess 30 has the recess top portion 32 which includes recess top corners 78 each having a recess top corner wall thickness 80. The recess top corners 78 are shown in FIG. 12*c* in the deformed state. FIG. 12*b* shows a pair of recess vertical edges 82 each having a recess vertical edge wall thickness 84 extending between the recess top and bottom corners 78, 38. The recess vertical edges 82 are also shown in the deformed state in FIG. 12*b* as may occur following impact with a hard surface or object. It should be noted that although recess top and bottom corners 38, 78 and recess vertical edges 82 are described as corners and are illustrated in the figures as having a rounded profile of an exemplary radius, nothing herein should be construed to limit the shape of recess top and bottom corners 38, 78 and recess vertical edges 82 to configuration shown.

In this regard, recess top and bottom corners 38, 78 and recess vertical edges 82 may have a chamfered profile, or may be provided in a radius other than that which is shown in the figures. For example, recess top and bottom corners 38, 78 and recess vertical edges 82 may have a relatively large radius. Furthermore, recess top and bottom corners 38, 78 and recess vertical edges 82 may include a chamfered profile in combination with a radius profile, or any other profile suitable to provide the impact absorbing characteristics described herein. Such characteristics are provided at least in part by the intentional thinning of recess top and bottom corners 38, 78 and recess vertical edges 82. Such thinning provide that additional benefit of reducing overall preform material used in the finished container which results in reduced container weight and cost.

In this regard, in one aspect of the present invention, the recess top and bottom corner wall thicknesses 80, 40 as well as the recess vertical edge wall thicknesses 84 are preferably less than the second body wall thickness 22 of the second container body 18 such that the recess top and bottom corners 78, 38 and vertical edge corners 82 are deformable in response to an impact caused thereagainst. Importantly, the recess top and bottom corners 78, 38 are specifically configured to be deformable or to crush or partially collapse in response to an impact caused thereupon such as may occur when the second container body 18 is dropped from a height onto a floor.

Due to the deformability, collapsibility or crushability of the recess top and bottom corners 78, 38 and vertical edge corners 82 and/or due to deformability or crushability of other corners of the second container body 18 such as the second body corner 74, shock imparted to the second container body 18 as a result of impact may be at least partially attenuated. In this manner, such shock is transmitted to the generally thicker second body wall such that rupture of the second container 14 is prevented and spillage of the contents contained within the second container body 18 is also prevented. It has been observed that such shock is typically transmitted to a back side of the body recess 30 which can be seen in FIG. 12. Rupture frequently occurs at this location due to droppage of the second container from excessive heights. As was earlier mentioned, such droppage of the second container 14 may occur during manufacturing, shipping or in a retail or distributorship setting. However, impacts may occur in a wide variety of scenarios.

In a preferred embodiment of the present invention, the second body wall thickness 22 and the recess top and bottom corner wall thicknesses 80, 40 and the recess vertical edge wall thicknesses 84 are preferably within the range of from about 0.005 in. to about 0.5 in. and more preferably are within the range from about 0.01 in. to about 0.20 in. and most preferably in the range of from about 0.012 to about 0.014 in. However, it should be noted that the recess top and bottom corner wall thicknesses 80, 40 and the recess vertical edge wall thicknesses 84 may be provided in any thickness that promotes their partial deforming to facilitate shock absorption to the second container. The second body wall thickness 22 has been determined to possess a thickness in the range of from about 0.049 in. to about 0.096 in although other thickness ranges are contemplated for the second body wall thickness 22.

Referring back to FIGS. 1-3, the body recess 30 of the second container body 18 can be seen in an angular offset orientation relative to the proximal and distal parting lines 26, 28 of the second container body 18. In particular, the preferred angular offset of the body recess 30 is approximately 90° relative to each of the proximal and distal parting lines 26, 28. Such specified angular offsetting of the body recess 30 provides a maximum distance from each of the parting lines 26, 28 where the two body halves of the second container body 18 come together to collectively form the second container body 18. Such an arrangement allows the body recess 30 to better remain intact and maintain the structural integrity of the wall thickness throughout the second container body 18 after the recess top and/or bottom corners 78, 38 and/or recess vertical edges 82 are deformed in response to an impact.

Further advantage in the angular offsetting lies in the fact that such positioning allows the plastic material of the second container body 18 to properly stretch and expand when blow-molded and therefore prevents undesirable thinning of certain areas of the second container body 18 during the molding process. Such angular offset positioning is understood to provide the most efficient accommodation of the body recess 30 and thereby ensures that the second container 14 is fabricated optimally. It should be noted that at least one additional body recess 30 may be optionally formed within or upon the second container body 18. For example, if a pair of the body recesses 30 are formed within the second container body 18, it is foreseeable that such body recesses 30 are diametrically disposed from one another. However, such body recesses 30 may be provided in any angular orientation relative to one another.

The body recess 30 formed along the second container 14 is preferably sized and configured to engage and accommodate a selective portion of the first container body 16 therewithin. In this respect, a remaining portion of the first container body 16 not engaged and accommodated within the body recess 30 becomes exposed outside the body recess 30 and protrudes outwardly there beyond. However, it should be noted that the body recess 30 may optionally be deepened in order to accommodate the first container body 16 completely therewithin.

Although various devices and methods may be used for engaging and accommodating the first container body 16, a plurality of lateral body extensions 42 are preferably provided by the second container body 18 to be used for such purpose. More specifically, each of the lateral body extensions 42 are preferably extended generally perpendicularly in relation to the second body height 20 and partially extending into the body recess 30. By such configuration, the lateral body extensions 42 may most efficiently capture and retain the accommodated portion of the first container body 16 within the body recess 30. In this manner, the first container 12 may be easily snapped into and out of the body recess 30 wherein each of the lateral body extensions 42 temporarily deflects in order to apply a slight frictional or compressive force upon the first container body 16 for retention.

FIGS. 1 and 2 illustrate a handle 44 which is extended along the second body height 20 of the second container body 18. Preferably, such handle 44 is substantially aligned with the proximal parting line 26 and is therefore disposed substantially opposite from the distal parting line 28. Furthermore, the handle 44 of the second container body 18 is preferably angularly offset approximately 90° relative to the body recess 30 for reasons related to providing better structural integrity for withstanding unwanted external impacts on the second container body 18. Moreover, such positioning of the handle 44 allows the plastic material to stretch and expand when blow-molded and is therefore the most efficient manner for accommodating and providing the handle 44 for the second container body 18.

Referring particularly to FIGS. 1 and 3, the second container body 18 preferably includes a supporting shelf 46. In the preferred embodiment of the present invention, the supporting shelf 46 is extended generally perpendicularly relative to the second body height 20 of the second container body 18. Furthermore, the supporting shelf 46 is preferably extended around and within the body recess 30 adjacent to the recess top and/or bottom corners 78, 38 and/or recess vertical edges 82 of the body recess 30. By providing such formed shelf 46, the accommodated portion of the first container body 16 may be vertically supported upon the supporting shelf 46. Such arrangement is understood to prevent inadvertent or unintended slippage of the first container body 16 out of the body recess 30 of the second container body 18.

Regarding materials from which the second container body 18 may be fabricated, in a preferred embodiment, the second container body 18 is preferably fabricated from extrusion blow-moldable copolyester material. In other embodiments, the second container body 18 may be fabricated from any one of the following: polyvinyl chloride (PVC), clarified polypropylene, polyethylene, and polycarbonate. In another embodiment, the second container body 18 may be fabricated from modified polyethylene ("modified PET") which may be formulated as an extrusion blow-moldable copolyester material. Advantageously, the use of extrusion blow-moldable copolyester material as a fabricating material results in an improved level of clarity for the second container body 18 of the second container 14.

It was discovered that fabricating the second container 14 from extrusion blow-moldable copolyester results in improved resistance of the second container body 18 to rupture due to the recess top and/or bottom corners and/or recess vertical edge wall thicknesses 80, 40, 84 being less than the second body wall thickness 22. As was earlier mentioned, the recess top and/or bottom corners 78, 38 and/or recess vertical edges 82 were deformable in response to impacts caused thereagainst such that rupture of the second container 14 is prevented. It was further discovered that, similar to modified PET, extrusion blow-moldable PVC results in improved flexibility and resistance to cracking while retaining clarity over time as compared to other polymeric materials.

In addition, fabricating the second container body 18 from extrusion blow-moldable PVC results in improved impact resistance for the second container body 18. An extrusion blow-moldable copolyester material that may be used in fabricating the second container body 18 is Eastar Copolyester EB062, commercially available from the Eastman Chemical Company and described in U.S. Pat. No. 4,983,711 issued to Sublett et al. on Jan. 8, 1991 and which is entitled COPOLYESTERS AND ARTICLES EXTRUDED AND BLOW-MOLDED THEREFROM, the entire contents of which being incorporated by reference in its entirety herein.

The use of extrusion blow-moldable PVC, clarified polypropylene, modified PET (i.e., extrusion blow-moldable copolyester) and polycarbonate is understood to facilitate the formation of relatively large articles such as the second container body 18 of the container system 10 of the present invention. Fabricating the second container 14 from PVC, modified PET and polycarbonate further provides the second container body 18 with improved aesthetics. In this regard, it has been discovered that fabricating the second container body 18 from extrusion blow-moldable PVC, extrusion blow-moldable copolyester (i.e., modified PET), and polycarbonate results in a relatively glossy surface finish to the outer surfaces of the second container body 18.

In addition, it was discovered that fabricating the second container body 18 from the above-mentioned materials such as Eastar Copolyester EB062 advantageously results in less shrinkage of the second container body 18 as compared to when the second container body 18 is fabricated using polyethylene. The ability to limit such shrinkage prevents the formation of depressions in the walls of the containers during the curing process which, in turn, creates fitment problems of the first container 12 with the second container 14. In this regard, the use of extrusion blow-moldable PVC, Eastar Copolyester EB062, or polycarbonate, allows an observer to accurately discern the visual attributes of the product contained within the second container 14 in a manner that may be more visually appealing.

It has also been discovered that fabricating the second container 14 from the above-mentioned materials results in improved flow characteristics during the molding process. Such improved flow of the material during forming results in a desired thickness through certain portions of the second container body 18 such as within the second body sides 24 and bottom panel 72 of the second container body 18. Furthermore, achieving desired thickness in the second body sides 24 allows for the proper formation of specific features or portions of the second container body 18.

Figure 12A:
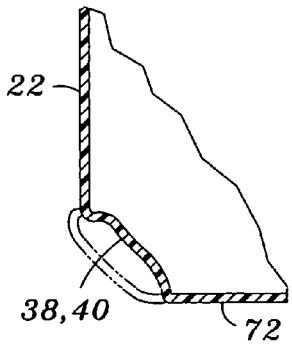
FIG. 12*a* is an enlarged cross sectional view of a recess bottom corner area of the second container having a partially collapsed or deformed wall thickness as a result of the drop impact testing performed thereon.

Additionally, each of the above-mentioned materials provide the second container body 18 with favorable mechanical properties such that the second container 14 is capable of withstanding repetitive impacts such as may occur when the container system 10 is dropped or mishandled during shipment, storage and manufacturing, as well as during everyday use. In this regard, Applicant has unexpectedly discovered that fabricating the second body 14 from the above-mentioned materials allows the recess top and/or bottom corners 78, 38 of the body recess 30 to be formed with a recess top and bottom corner wall thickness 80, 40 that is preferably less than the second body wall thickness 22 such that the recess top and/or bottom corners 78, 38 may adequately deform, as illustrated in FIGS. 12*a* and 12*c*.

As evidenced by the drop tests illustrated in the charts of FIGS. 13*a*-13*c*, the second container body 18 having the differential thicknesses between the recess top and/or bottom corners wall thickness 80, 40 and the second body wall thickness 22, allows the second container body 18 to survive drops from a height of six feet with substantially no damage and no rupturing of the second container body 18 despite the fact that the second container body 18 is only predicted to survive a drop of up to about three feet without rupturing.

As was earlier mentioned, the second container body 18 may be fabricated from polycarbonate material. Such polycarbonate material may be similar to that which is disclosed in U.S. Pat. No. 4,034,016 issued to Baron et al. on Jul. 5, 1977 and which is entitled TERNARY POLYBLENDS PREPARED FROM POLYBUTYLENE TEREPHTHALATES, POLYURETHANES AND AROMATIC POLYCARBONATES, the entire contents of which is incorporated by reference herein. It has been discovered that although polycarbonates similar to that disclosed in U.S. Pat. No. 4,034,016 may possess a slightly yellowish tint, the addition of blue tint partially offsetting such yellow tint and thereby improves the aesthetics of the second container body 18.

The second container body 18 may be further formed of extrusion blow-moldable clarified polypropylene which is commercially available from Milliken and Company of Spartanburg, S.C. Such clarified polypropylene has improved clarity as compared to traditional polypropylene due to the addition of nucleating or clarifying agents in the polypropylene. Although clarified polypropylene does not result in the same level of clarity as that which is attainable using extrusion blow-moldable PVC, polycarbonate or modified PET, it is believed that clarified polypropylene is a suitable material for fabricating the second container body 18 due to its favorable strength properties as well as due to its improved clarity as compared to polyethylene.

With the structures of the present dual container system 10 now defined, its method of manufacture can be clearly described in view of FIGS. 5-11 provided herein. In order to manufacture the dual container system 10 as specified above, the first container 12 of the container system 10 is first formed, preferably through a plastic blow molding process. As stated above, the first container 12 may be manufactured in a similar manner as the second container 14 as will be described below, or manufactured in accordance with conventional modes of the blow molding process. This is because it is the second container 14 which is the component of the overall dual container system 10 that is often subjected to tear and rupture during its shipment, storage or handling.

Figure 7:
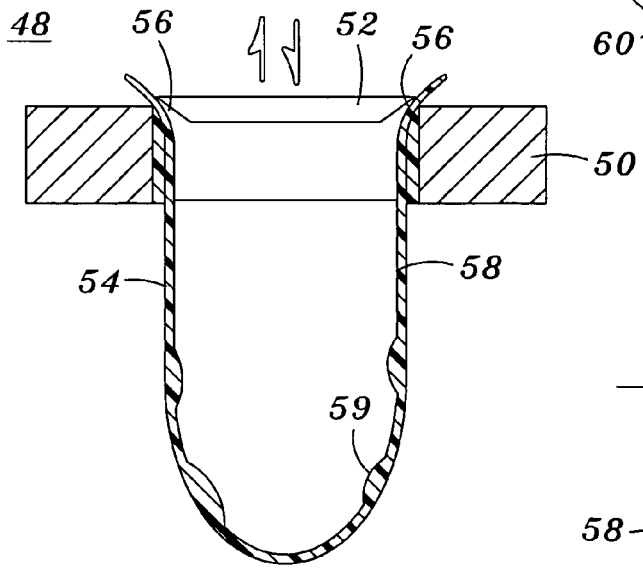
FIG. 7 is a cross-sectional view of the injection control unit shown in FIG. 5 and illustrating the injection control member which is sized and configured for strategic movement with respect to an injection unit body so as to regulate material flow to an expandable molding balloon.

The process of forming the second container 14 of the container system 10 is also preferably through a plastic blow molding process. More particularly, to form the second container 14, a preform material 58 is first injected into an injection control unit 48 of a blow molding machine (step 104). Various customized blow molding machines may be used for this purpose. One exemplary machine which may be used is the blow molding machine model #BW F16D (UMS 16D)

from Uniloy Milacron, Inc. of Ohio, U.S.A. Such blow molding machine preferably comprises a customized injection control unit 48. This customized injection control unit 48 is formed essentially of an injection unit body 50 and an injection control member 52 which are used to form an expandable molding balloon 54 which is extended through the injection unit body 50, as best shown in FIG. 7.

The customized version of the injection control unit 48 is adapted to provide an openable/closeable injection gap 56 between its injection unit body 50 and the injection control member 52. The preform material 58 is injected into the injection control unit 48 through the injection gap 56 when it is opened. Thereafter, the injection control member 52 of the injection control unit 48 is strategically moved upward-and-downward and/or side-to-side with respect to the injection unit body 50 in order to allow for opening, closing and otherwise varying the size of the injection gap 56 (step 104).

Figure 8:
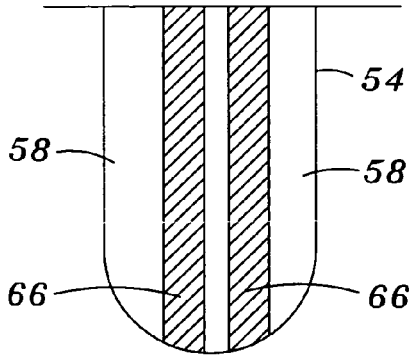
FIG. 8 is a cross-sectional view of the expandable molding balloon shown in FIG. 7 to illustrate thicker material flow resulting from the injection scallops.
Figure 9:
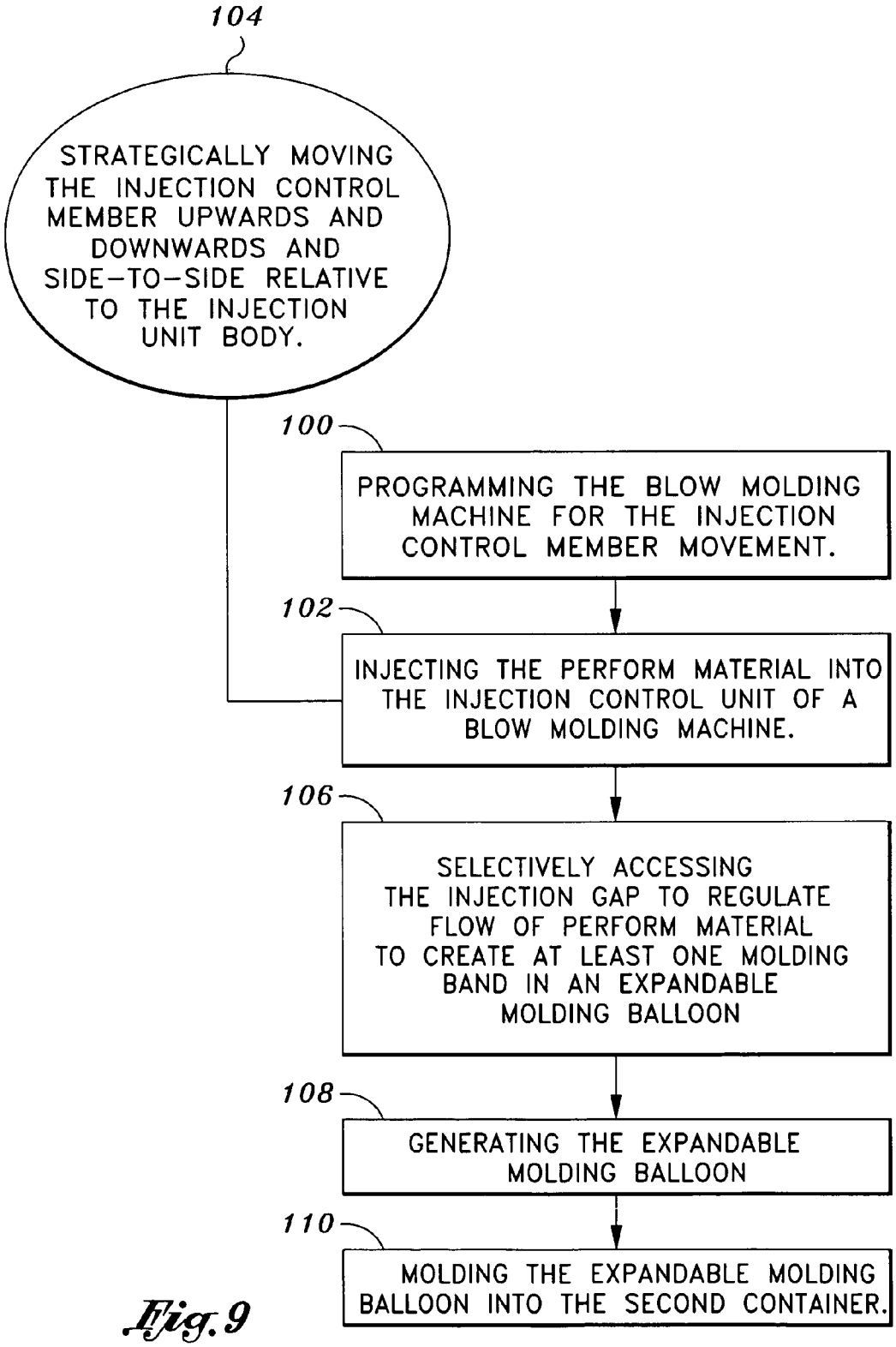
FIG. 9 is a flow diagram depicting manufacturing steps in forming the dual container system.

This is to regulate the flow of the preform material 58 through the injection gap 56 and to create the expandable molding balloon 54 (step 108). In the preferred embodiment of the present invention, the injection control member 52 has a generally oval configuration and creates the injection gap 56 around its oval periphery. The oval shape in itself will provide a greater flow in strategic areas of the molding balloon 54, thus thickening the molding balloon 54 (step 106) in those areas vertically as is best shown in FIG. 8.

Figure 10:
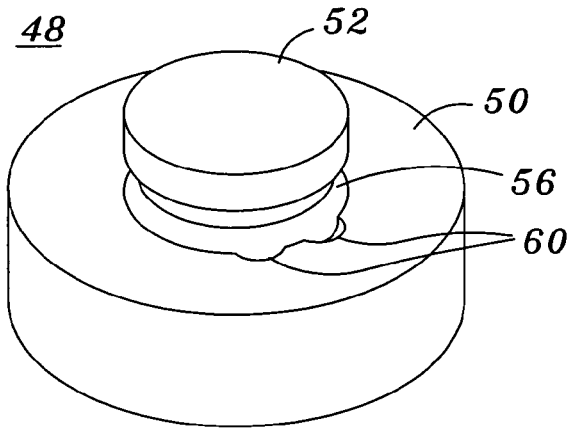
FIG. 10 is a perspective view of the injection control unit comprising the injection control member and the injection unit body and further illustrating the two injection scallops formed on an interior edge of the injection unit body.
Figure 11:
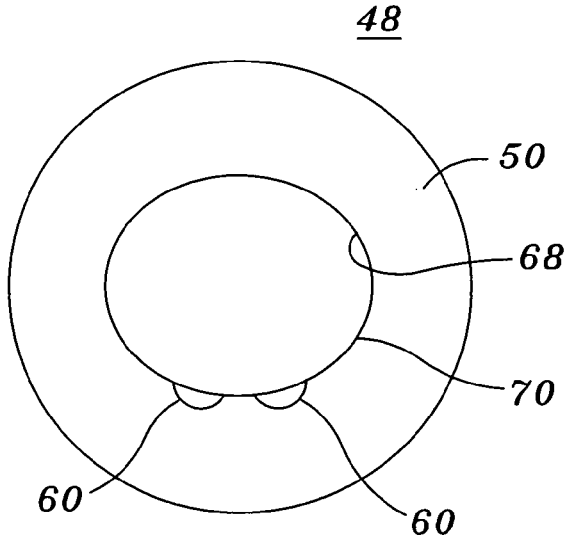
FIG. 11 is a top plan view of the injection unit body shown in FIG. 10 and illustrating the generally oval configuration of the injection unit body

Referring more particularly now to FIGS. 10 and 11, in another preferred embodiment of the invention, the injection unit body 50 defines an interior surface 68 with an interior edge 70. The interior surface 68 may have a generally oval or circular configuration in one of the preferred embodiments. The oval shape of the interior surface 68, in combination with a generally circular shape of the injection control member 52, will provide a greater flow of material through the injection gap 56 which, in turn, results in greater flow of material to strategic areas of the expandable molding balloon 54, thus thickening the molding balloon 54 in those areas vertically and thereby allowing certain features to be formed. In this regard, it is contemplated that the injection unit body 50 has a generally oval configuration while the injection control member 52 has a generally circular shape. Alternatively, however, the injection control member 52 may have a generally oval shape while the injection unit body 50 may have a generally circular configuration, as described above.

The interior surface 68 of the injection unit body 50 also defines an interior edge 70 on a side of the injection unit body 50. At least one and preferably two injection mold scallops 60 may be provided on the interior edge 70 of the injection unit body 50 in order to further provide a greater flow in strategic areas of the molding balloon 54, as shown in FIG. 8, in order to generate the vertical thickened portions 66.

In this regard, it is contemplated that the interior surface 68 of the injection unit body 50 may be provided with a generally circular shape, as opposed to the generally oval shape, and that at least one scallop 60 may either be included or omitted from the interior edge 70, depending upon the desired molding characteristics and molding material that is used. It should be noted that the injection mold scallops 60 may be included in either an ovally-shaped or a circularly-shaped configuration of the injection control member 52 and/or of the injection unit body 50. The scallops 60 and the oval configuration may both generate generally thickened portions as shown in FIG. 8.

Although the oval configuration of the injection unit body 50 and/or of the injection control member 52 is preferred, it should be noted herein that other types of configurations are also workable with the methodology of the present invention. For instance, the injection unit body 50 and/or the injection control member 52 may be more or less rounded. In this manner, when the injection control member 52 is brought to the injection unit body 50, they collectively define a slightly differently-shaped injection gap 56 than the one provided by the oval configuration.

This may affect the flow to the molding balloon 54 but nonetheless provides the desired flow to strategic areas of the molding balloon 54. In addition to such alternative shapes of the injection unit body 50 and/or of the injection control member 52, it is also recognized herein that the injection control member 52 may be shifted toward one particular side of the injection unit body 50 so as to define different variations of the injection gap 56 which will produce the desired flow.

To conduct such strategic movement of the injection control member 52, the blow molding machine and its injection control unit 48 is first set or programmed (step 100) to account for a plurality of points where the second body wall thickness 22 of the second container body 18 could undesirably change due to extreme stretching of the molding balloon 54 possibly due to the shape of the body recess 30. In order to exemplify this concept, the blow molding machine is programmed in approximately up to one hundred points or locations where thicknesses of the second container body 18 may change, and to account for such undesirable thickness changes (step 102).

Based upon this presetting or preprogramming of the blow molding machine, the injection control member 52 is then moved selectively and strategically in upward, downward or side-to-side directions relative to the injection unit body 50 (step 104). This selectively accesses the injection gap 56 which is provided between the injection control member 52 and the injection unit body 50 in order to control the flow of the preform material 58 to the expandable molding balloon 54 (step 106).

The manufacturing method further includes the step of selectively regulating the flow of the preform material through the injection gap 56 to create at least one molding band 59 in the expandable molding balloon 54 for the recess top and/or bottom corners 78, 38 of the body recess 30 to have a recess bottom corner wall thickness 40 that is completely formed but which has a thickness which is less than the second body wall thickness 22 (step 106). In this process, the body recess 30 and, more particularly, the recess top and/or bottom corners 78, 38 and/or recess vertical edges 82, are at least thickened only to the extent that such feature is formed during the blow molding process. As was mentioned above, the expandable molding balloon 54 is molded into the second container 14 (step 110) to create the body recess in the second container 14.

In order to derive the recess top and/or bottom corners 78, 38 and/or recess vertical edges 82, the flow of the preform materials 58, such as the PVC material, designated for forming the recess top and/or bottom corners 78, 38 and/or recess vertical edges 82 may be increased due to the addition of the molding bands 59 in the expandable molding balloon 54 which are represented as the thickened areas in FIG. 7. Such thickened areas are formed by increasing the gap 56 such that a greater amount of preform material 58 flows therethrough and which causes a local increase in the thickness of the expandable molding balloon 54.

The molding bands 59 are generally formed in a circumferential or circular orientation. However, as was earlier mentioned, the recess top and bottom corner wall thicknesses 80, 40 as well as the recess vertical edge wall thicknesses 84 are preferably less than the second body wall thickness 22 of the second container body 18 such that the recess top and bottom corners 78, 38 and vertical edge corners 82 are deformable in response to an impact. In this regard, the recess top and bottom corners 78, 38 are specifically configured to crush in response to an impact caused thereupon such as may occur when the second container body 18 is dropped.

Such molding bands 59 are also preferably strategically located at the point where the recess top and/or bottom corners 78, 38 and/or recess vertical edges 82 of the second container 14 will be formed. The flow of the preform materials 58 designated for forming the recess top and/or bottom corners 78, 38 and/or recess vertical edges 82 may be increased at the molding bands 59 due primarily by moving the injection control member 52 in and out relative to the injection unit body 50 to locally increase the injection gap 56. The flow of the preform material 58 may also be secondarily increased due to the ovality formed at the outer periphery 62 of the injection control member 52 and/or due to the ovality formed at the interior edge of the injection unit body 50 or a combination of ovality formed in both of the outer periphery 62 and the interior edge 70.

In addition, vertical thickened portions 66 may be formed as shown in FIG. 8. Such vertical thickened portions 66 are preferably strategically located so as to coincide at an intersection of the body recess 30 and the second container body 18 sides (i.e., the recess vertical edges 82) as shown in FIGS. 1-3 and 12. Each one of the intersections is vertically oriented as shown in FIG. 1 and forms the recess vertical edge 82 which is preferably radiused. The vertical thickened portions 66 are formed primarily due to the oval configuration formed on the injection unit body 50 and/or on the injection control member 52. The vertical thickened portions 66 are formed secondarily due to the inclusion of the injection scallops 60 in the injection unit body 50 and/or in the injection control member 52. The vertical thickened portions 66 may also be formed by moving the control member to one side of the unit body in order to increase the injection gap on the opposing side which has the effect of also increasing the flow and thickness of preform material on the opposing side of the molding balloon.

Preferably, there are two of the injection scallops 60 formed on the injection unit body 50 and/or on the injection control member 52, each being designated for forming one of the vertical edges of the body recess 30. By providing these injection scallops 60, the flow of the preform material 58 to selected portions of the expandable molding balloon 54 may be increased in order to allow formation of the recess bottom corners and the vertical edges of the body recess. The body recess 30 may be angularly offset approximately 90° from each of the parting lines 26, 28.

Also in the process, the handle 44 may be extended upon the second container 14. As noted above, the handle 44 is disposed in substantial alignment with one of the parting lines 26 and is further disposed substantially opposite from the other parting line 28. The handle 44 should also be formed to be angularly offset approximately 90° from the body recess 30. Further in the process, the supporting shelf 46 is also provided for supporting the first container 12 thereupon. As indicated above, the supporting shelf 46 is preferably extended within the body recess 30 adjacent to its recess top and/or bottom corners 78, 38 and/or recess vertical edges 82.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A method of manufacturing a container system with an injection control unit having an injection unit body, the method comprising the steps of:

a) forming a first container of the container system; and b) forming a second container of the container system, the second container having two opposing parting lines and a second body wall thickness, the second container having a body recess with at least one of a recess top and bottom corner and at least one recess vertical edge, comprising the steps of:

1) injecting a preform material into the injection control unit;

2) strategically moving an injection control member of the injection control unit with respect to the injection unit body to regulate a flow of the preform material for creating an expandable molding balloon, the injection unit body having an interior edge with a generally oval configuration;

3) selectively regulating the flow of the preform material to generate at least one of a recess top and bottom corner and vertical edge wall thickness of the second container;

4) forming at least one of the recess top and bottom corner and vertical edge wall thickness to be thinner than the second body wall thickness of the second container;

5) molding the expandable molding balloon into the second container to create the body recess in the second container such that only a portion of the first container is accommodated in the body recess and a remaining portion of the first container is exposed outside the body recess and protrudes outward beyond the second container, the body recess being adapted to releasably engage the first container, the first container being retained within the body recess by an opposing pair of lateral body protrusions; and 6) withstanding an impact upon the second container due to at least one of the recess top and bottom corners and vertical edges deforming in response to an impact thereagainst such that rupture of the second container is prevented.

2. The method of claim 1 wherein the preform material in step b1) is at least one of the following: extrusion blow-moldable polyvinylchloride, modified PET, clarified polypropylene, polyethylene, polycarbonate.

3. The method of claim 1 wherein step b1) comprises:

i) defining an openable/closeable injection gap between the injection unit body and the injection control member; and ii) injecting the preform material into the injection control unit through the injection gap when the gap is opened.

4. The method of claim 1 wherein step b2) comprises:

i) setting the injection control unit for strategically moving the injection control member so as to account for a plurality of points where the second body wall thickness changes;

ii) moving the injection control member in at least one of upward-and-downward and side-to-side directions relative to the injection unit body based upon the presetting thereof; and iii) selectively accessing an injection gap provided between the injection control member and the injection unit body to control the flow of the preform material to the expandable molding balloon.

5. The method of claim 1 wherein step b4) comprises:

i) offsetting the body recess approximately 90° from each of the parting lines.

6. The method of claim 1 wherein step b4) comprises:

i) extending a handle upon the second container in substantial alignment with one of the parting lines and substantially opposite from the remaining parting line; and ii) offsetting the handle approximately 90° from the body recess.

7. The method of claim 1 wherein step b4) comprises:

i) extending a supporting shelf within the body recess adjacent to the at least one recess top and bottom corner for supporting the first container thereupon.

8. The method of claim 1 wherein an intersection of the body recess with the second container forms at least one vertical edge and wherein step b3) comprises:

i) defining an interior edge of the injection unit body;

ii) defining at least one injection scallop formed on the interior edge for forming a vertical thickened portion of the expandable molding balloon; and iii) increasing the flow of the preform material through the at least one injection scallop to form the recess vertical edge from the vertical thickened portion.

9. The method of claim 1 wherein the injection control member has a generally oval configuration.

* * * * *